US009901136B2

(12) United States Patent
Fujita et al.

(10) Patent No.: US 9,901,136 B2
(45) Date of Patent: Feb. 27, 2018

(54) SHOCK ABSORBING STRUCTURE FOR SHOE SOLE SIDE FACE AND SHOE TO WHICH THE SHOCK ABSORBING STRUCTURE IS APPLIED

(71) Applicants: ASICS CORPORATION, Kobe-shi, Hyogo (JP); TAICA CORPORATION, Tokyo (JP)

(72) Inventors: Hisanori Fujita, Kobe (JP); Manabu Mikuni, Tokyo (JP); Hiroshi Nasuno, Tokyo (JP)

(73) Assignees: ASICS CORPORATION, Kobe-shi (JP); TAICA CORPORATION, Tokyo (JP)

( * ) Notice: Subject to any disclaimer, the term of this patent is extended or adjusted under 35 U.S.C. 154(b) by 0 days.

(21) Appl. No.: 15/031,208

(22) PCT Filed: Oct. 21, 2013

(86) PCT No.: PCT/JP2013/078443
§ 371 (c)(1),
(2) Date: Apr. 21, 2016

(87) PCT Pub. No.: WO2015/059744
PCT Pub. Date: Apr. 30, 2015

(65) Prior Publication Data

US 2016/0262492 A1 Sep. 15, 2016

(51) Int. Cl.
*A43B 13/18* (2006.01)
*A43B 21/26* (2006.01)
(Continued)

(52) U.S. Cl.
CPC ..... *A43B 13/186* (2013.01); *A43B 13/125* (2013.01); *A43B 13/141* (2013.01);
(Continued)

(58) Field of Classification Search
CPC ..... A43B 13/18; A43B 13/181; A43B 13/185; A43B 13/20; A43B 21/26; A43B 21/28; A43B 21/32
(Continued)

(56) References Cited

U.S. PATENT DOCUMENTS 226,792 A 4/1880 Robinson
5,224,280 A * 7/1993 Preman ..... A43B 1/0072 36/107
(Continued)

FOREIGN PATENT DOCUMENTS

EP 1844673 A1 10/2007
JP H03-85103 A 4/1991
(Continued)

OTHER PUBLICATIONS

Jan. 14, 2014 International Search Report issued in International Patent Application No. PCT/JP2013/078443.
(Continued)

*Primary Examiner* — Marie Bays
(74) *Attorney, Agent, or Firm* — Oliff PLC

(57) ABSTRACT

A structure including hard bone portion extending to a sole side face outer side at a time of pressure reception, and elastic soft skin portion provided at an outer side of the hard bone portion, absorbs impact at a time of landing and the like, where at least part of the hard bone portion is along sole side face, and the elastic soft skin portion have a structure wherein at a time of pressure reception, the hard bone portion undergoes bending deformation in a vertical section to extend to the sole lateral side, and by receiving the deformation, the elastic soft skin portion undergoes elastic deformation to bulge to the sole lateral side to absorb a received pressure load, thereafter, with decompression, the elastic soft skin portion undergoes elastic deformation to
(Continued)

contract to the sole inner side, and with this, the hard bone portion is restored to an initial state.

13 Claims, 10 Drawing Sheets

(51) Int. Cl.
*A43B 13/12* (2006.01)
*A43B 13/14* (2006.01)

(52) U.S. Cl.
CPC ..... *A43B 13/181* (2013.01); *A43B 13/185* (2013.01); *A43B 21/26* (2013.01)

(58) Field of Classification Search
USPC ..... 36/25 R, 28, 29, 35 R, 37
See application file for complete search history.

(56) References Cited

U.S. PATENT DOCUMENTS 5,678,327 A * 10/1997 Halberstadt ..... A43B 13/18 36/27
5,743,028 A * 4/1998 Lombardino ..... A43B 13/182 36/27
6,055,747 A * 5/2000 Lombardino ..... A43B 13/182 36/27
7,131,218 B2 * 11/2006 Schindler ..... A43B 13/187 36/29
7,779,558 B2 * 8/2010 Nishiwaki ..... A43B 13/181 36/27
7,987,618 B2 * 8/2011 Nishiwaki ..... A43B 13/181 36/25 R
8,178,022 B2 * 5/2012 Schindler ..... A43B 13/12 12/146 B
8,479,412 B2 * 7/2013 Peyton ..... A43B 13/20 36/28
8,490,296 B2 * 7/2013 Hurd ..... A43B 13/026 36/103
8,640,361 B2 * 2/2014 Testa ..... A43B 13/181 36/27
2002/0038522 A1 * 4/2002 Houser ..... A43B 7/1415 36/28
2002/0073579 A1 * 6/2002 Lombardino ..... A43B 13/182 36/28
2005/0198863 A1 * 9/2005 Hockerson ..... A43B 5/06 36/30 R
2007/0240331 A1 10/2007 Borel
2008/0201982 A1 * 8/2008 Aveni ..... A43B 13/20 36/29
2009/0031584 A1 * 2/2009 Rasmussen ..... A43B 7/24 36/88
2009/0178300 A1 7/2009 Parker
2009/0320330 A1 12/2009 Borel et al.
2010/0263227 A1 * 10/2010 Aveni ..... A43B 13/181 36/28
2012/0042541 A1 * 2/2012 Miner ..... A43B 13/122 36/88
2015/0013185 A1 * 1/2015 Elder ..... A43B 13/14 36/83
2015/0157088 A1 * 6/2015 Seo ..... A43B 1/0018 36/25 R
2015/0173456 A1 * 6/2015 Rushbrook ..... A43B 13/141 36/25 R
2016/0058122 A1 * 3/2016 Foxen ..... A43B 13/125 36/28

FOREIGN PATENT DOCUMENTS

JP 2007-144211 A 6/2007
JP 2009-291448 A 12/2009
WO 2006/088441 A1 8/2006

OTHER PUBLICATIONS

Jan. 14, 2014 Written Opinion issued in International Patent Application No. PCT/JP2013/078443.
Jul. 10, 2017 Search Report issued in European Patent Application No. 13896072.9.

* cited by examiner

Figure 1 (b')

Figure 6
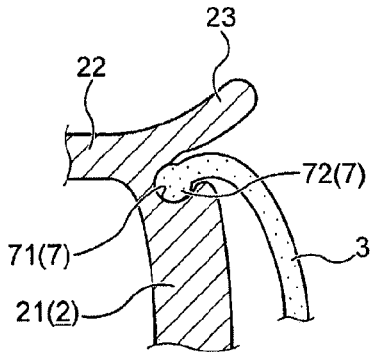
Figure 7 (a)
Figure 7 (b)
Figure 7 (c)
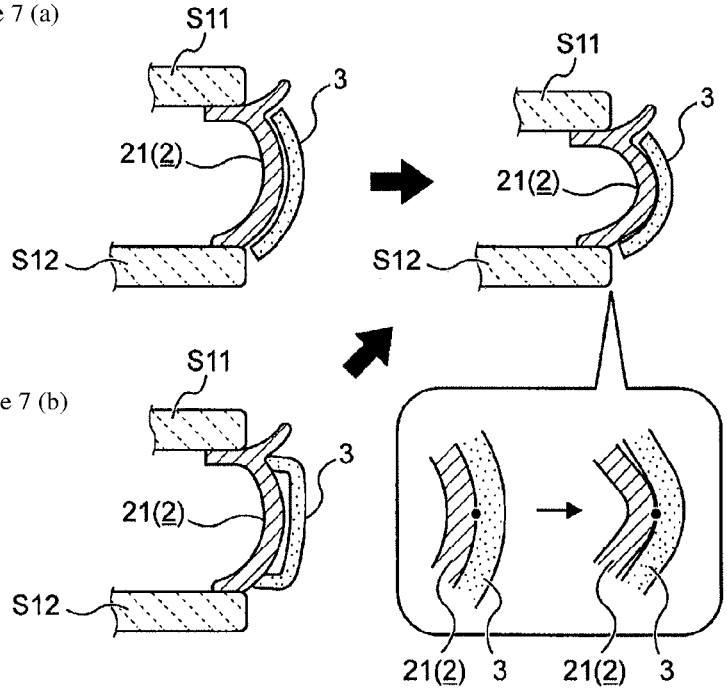

Figure 10
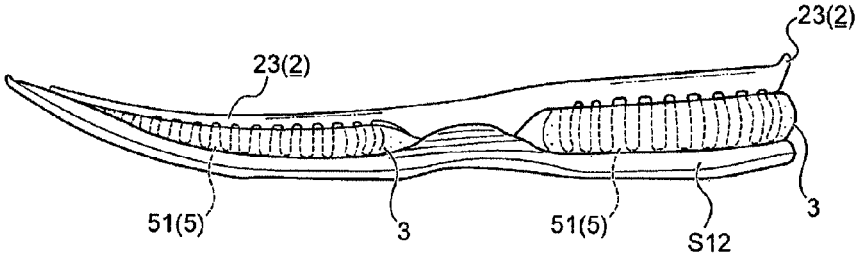
Figure 11 (a)
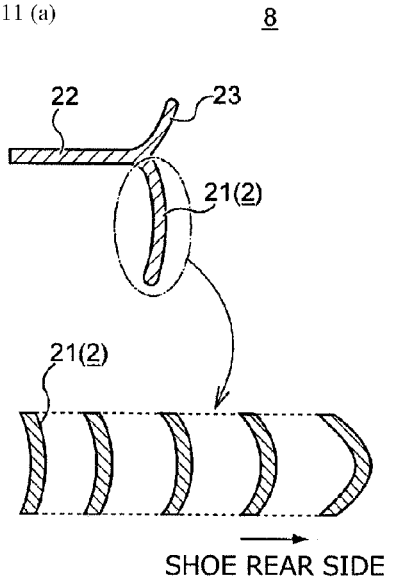
Figure 11 (b)
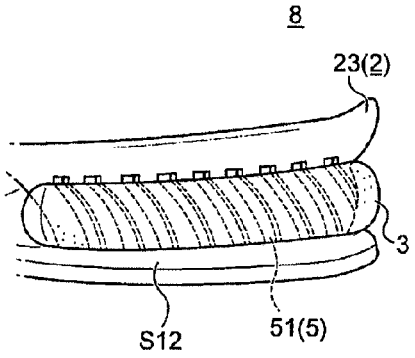
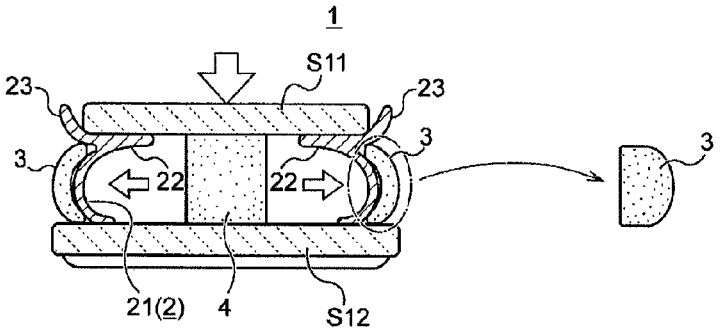
Figure 12

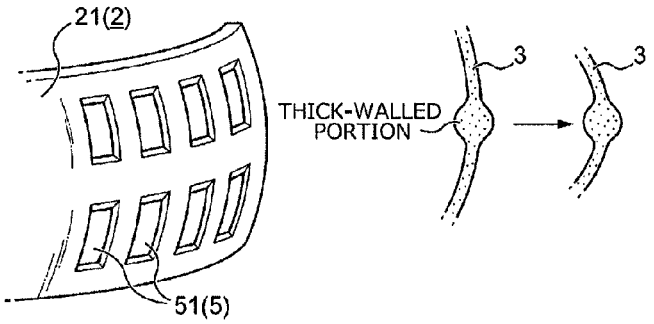
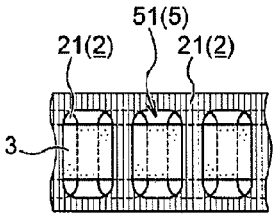
Figure 14 (b)
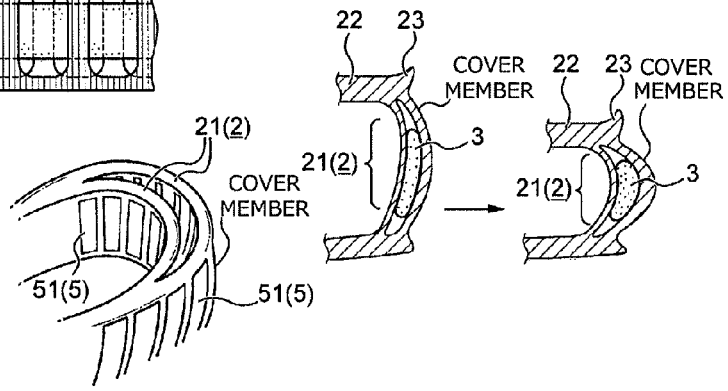
Figure 14 (c)
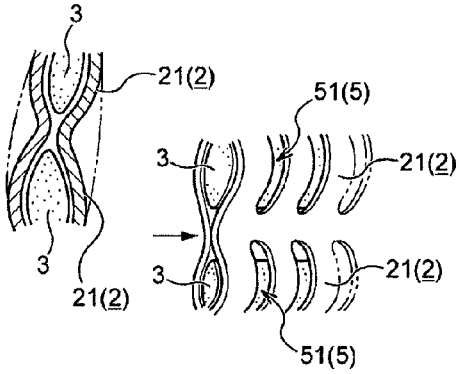
Figure 14 (d)
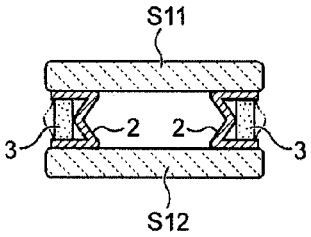

SHOCK ABSORBING STRUCTURE FOR SHOE SOLE SIDE FACE AND SHOE TO WHICH THE SHOCK ABSORBING STRUCTURE IS APPLIED

TECHNICAL FIELD

The present invention relates to a shock absorbing structure that is incorporated into, for example, a sole of a sports shoe, a running shoe or the like, so as to absorb impact that is applied to a leg of a wearer at a time of landing on the ground, and particularly relates to a novel shock absorbing structure for a sole side face that causes a shock absorbing member to extend significantly on a shoe side face at a time of pressure reception, while suppressing a use amount of a shock absorbing member of gel or the like, and thereby makes shock absorbing performance sufficiently appealing, while also achieving reduction in weight and cost reduction by the suppression of the use amount of the shock absorbing member, and a shoe to which this shock absorbing structure is applied.

BACKGROUND ART

In many sports shoes, running shoes and the like, shock absorbing members (shock absorbing structures) are incorporated in order to absorb and alleviate (shock absorption) impact which is applied to legs (feet, knees and the like) of those who wear the shoes. A number of research and development activities have been earnestly carried out, and various proposals have been made as the shock absorbing structures as above.

The present applicant has also realized excellent shock absorbing performance so far by adopting a unique structural design in which a shock absorbing member of a gel or the like is combined with a midsole material such as EVA (ethylene-acetic acid vinyl copolymer) as an example which makes the excellent shock absorbing characteristic and reduction in weight compatible (refer to Patent Literature 1, for example).

Many of these shock absorbing structures have caused shock absorbing members of an EVA, gel materials and the like to undergo compression deformation from the vertical direction to absorb shock, so far.

Meanwhile, in order to enable shoes users (wearers) and those who think about purchase of shoes to feel shock absorbing characteristics actually by seeing and touching, soft shock absorbing members (shock absorbing materials) can be exposed on the external appearances of the shoes with wide areas as much as possible. However, if the shock absorbing members like them are configured with relatively large thickness dimensions, the shock absorbing members become the cause of reducing stability when undergoing compression deformation, and are heavy with respect to EVA with increase in the area to be the cause of cost increase, so that the shock absorbing members also have an aspect of being desirably configured with the smallest possible use amount.

CITATION LIST

Patent Literature

Patent Literature 1: Japanese Patent Laid-Open No. 2007-144211 (Japanese Patent No. 4755616)

SUMMARY OF INVENTION

Technical Problem

The present invention is made by recognizing the background as above, and achieves development of a novel shock absorbing structure that can exhibit sufficient shock absorbing performance without depending on the conventional compression deformation while exposing a shock absorbing member of gel or the like on a shoe side face with a large area, and a shoe to which this shock absorbing structure is applied.

That is, on the precondition that the shock absorbing member of a gel or the like is applied to a shoe side face as a new shock absorbing structure, the present inventors have found out that high stability is realized while strong impact at a time of landing and at a time of kicking out is absorbed, and excellent effects are provided in reduction in weight and a cost aspect, by deflection and a tensile force of the shock absorbing member itself, rather than by causing the shock absorbing member to undergo compression deformation, and has reached the present invention.

Solution to Problem

A shock absorbing structure for a shoe sole side face of the present invention is a shock absorbing structure for a shoe sole side face including a hard bone portion that is provided between an insole and an outsole of a shoe and deforms in such a manner as to extend to an outer side of a sole side face at a time of pressure reception, and an elastic soft skin portion provided at an outer peripheral side of the hard bone portion, to absorb impact applied to a leg of a wearer at a time of landing on a ground, wherein at least a part of the hard bone portion is provided along the sole side face, and the hard bone portion and the elastic soft skin portion have a structure in which at the time of pressure reception, the hard bone portion undergoes bending deformation in a vertical section so as to extend to a lateral side of the sole, and by receiving the deformation, the elastic soft skin portion undergoes elastic deformation so as to bulge to the lateral side of the sole to absorb a received pressure load, and thereafter, with decompression, the elastic soft skin portion undergoes elastic deformation so as to contract to an inner side of the sole this time, and with this, the hard bone portion extended to the lateral side of the sole is restored to an initial state.

Further, the hard bone portion is preferably provided to be located under at least any one of a heel, a thenar, and a hypothenar, and a whole or a part of the hard bone portion is preferably disposed in a circular arc shape along the outer side of the sole side face, seen from above.

Further, the hard bone portion preferably includes a bending promotion structure that promotes bending deformation which extends to the lateral side of the sole at the time of pressure reception.

Further, a cover member is preferably further provided at an outer side of the elastic soft skin portion, and by the cover member, bulging deformation to the lateral side of the sole, of the elastic soft skin portion is preferably restricted.

Further, the hard bone portion and the elastic soft skin portion preferably include a mounting structure that holds at least a part of the elastic soft skin portion in an outer surface side of the hard bone portion.

Further, the elastic soft skin portion is preferably mounted so that at least a part of the elastic soft skin portion covers the hard bone portion continuously from an upper end edge to a lower end edge of the hard bone portion, and the mounting structures are preferably provided at upper end edges and lower end edges of the hard bone portion and the elastic soft skin portion, and at the time of pressure reception, the hard bone portion preferably bends to the lateral side of the sole, whereby the elastic soft skin portion is pulled to upper end and lower end sides.

Further, at least a part of the elastic soft skin portion is preferably not in contact with an outer surface of the hard bone portion at a time of no load, at least a part of an inner side surface of the elastic soft skin portion preferably contacts the outer surface of the hard bone portion at the time of pressure reception, and at a contact site, the elastic soft skin portion preferably has a larger radius of curvature in a height direction than the hard bone portion to undergo elastic deformation so as to bulge to the lateral side of the sole.

Further, at least one of the hard bone portion and the elastic soft skin portion is preferably formed to have a structure which is more easily deformed at the time of pressure reception toward a bottom face side or a rear side of the shoe.

Further, the hard bone portion and the elastic soft skin portion are preferably formed so that height dimensions become gradually smaller toward a front side of the shoe or a load shift direction at the time of pressure reception.

Further, at least one of the hard bone portion and the elastic soft skin portion preferably includes a guide structure that guides the received pressure load to a front side of the shoe or a load shift direction at the time of pressure reception.

Further, an auxiliary element that receives the received pressure load and performs compression deformation to assist in absorbing impact is preferably provided inside the hard bone portion.

Further, the elastic soft skin portion is preferably detachable and attachable.

Further, a shoe of the present invention is formed by incorporating a shock absorbing structure that absorbs impact that is applied to a leg of a wearer at a time of landing on a ground into a sole, wherein for the shock absorbing structure, the above described shock absorbing structure is applied.

Advantageous Effects of Invention

Since the elastic soft skin portion is provided (fitted on like a rubber ring, for example) at the outer peripheral side of the hard bone portion, the inner peripheral side of the hard bone portion can be made hollow, so that the use amount of the elastic soft skin portion which is often formed of a shock absorbing member of gel or the like can be reduced, and reduction in weight as a shoe and cost reduction can be achieved. Further, since at the time of pressure reception, the hard bone portion undergoes bending deformation so as to extend to the lateral side of the sole, and by receiving this, the elastic soft skin portion undergoes elastic deformation so as to bulge to the lateral side of the sole, even if the use amount of the elastic soft skin portion is small, the presence of the elastic soft skin portion, in other words, the shock absorbing performance of the shoes can be sufficiently made appealing.

Further, if the installation place and the installation mode of the hard bone portion are specified, the specific configuration becomes reality.

Further, the hard bone portion is not only the one in a ring shape (an endless shape) in which both ends are formed into a connected state seen from above, but also may be the one having both ends such as a U-shape, a circular arc shape or the like which is formed into a fragment shape as a part thereof, and this can be incorporated into the side face of a midsole (formed into parts and can be incorporated into a part of the sole).

Further, if the hard bone portion includes the bending promotion structure, the hard bone portion easily undergoes bending deformation to the lateral side of the sole at the time of pressure reception, and in the case of the received pressure loads which act having the same magnitudes, for example, the deformation to the lateral side of the sole can be generated as larger deformation.

As the bending promotion structure, for example, a slit partially opened to be substantially along the vertical direction, a partial thin-walled structure (a configuration in which the opening portion of the aforementioned slit is formed into a thin-walled shape), a perforated hole and the like are cited. Further, in the case of a slit, a state where the lower end edge of the opening portion is completely cut off (a so-called comb shape) is conceivable, and a state where upper and lower ends are connected and an opening portion is formed into a window shape in only a middle part (a vicinity of a center of the vertical section) other than the upper and lower ends is also conceivable, for example. Furthermore, it is also conceivable to form the hard bone portion (the shock absorbing structure) into a shape with a plurality of stages (a so-called multi-stage type) in vertical sectional view.

In this connection, when the slit (comb shape) is adopted as the bending promotion structure, the hard bone portion bends in such a manner that intervals of the comb extend along the outer side of the sole side face at the time of pressure reception as compared with the case where the hard bone portion is formed into a plate shape, and this gives an image of the elastic soft skin portion as if the elastic soft portion bulged greatly, and an apparent change can make a strong impression.

Further, if the cover member is provided at the outer side of the elastic soft skin portion, excessive deformation is not caused in the bonded portion of the elastic soft skin portion, the bonded portion is firmly fixed, and separation can be prevented. Further, by the installation position of the cover member, the hard bone portion can be caused to start bending deformation from a midway portion instead of causing the hard bone portion to undergo bending deformation entirely from upper and lower ends, and the bending position (the start position) of the hard bone portion can be adjusted.

Further, if the magnitudes of the received pressure loads are the same, by deformation from the midway portion as described above, extension to the lateral side of the sole can be visually recognized more remarkably than by bulging the whole of the hard bone portion, and therefore, the bending degree (the extension degree) can be adjusted (can be tuned) by the bulging position (the start position).

Note that the structure like this is also effective when the hard bone portion (the shock absorbing structure) is formed into a shape with a plurality of stages in vertical sectional view.

Further, if the hard bone portion and the elastic soft skin portion include the mounting structure, the elastic soft skin portion can be mounted to the outer side of the hard bone portion, without using an adhesive or the like. Consequently, the elastic soft skin portion can be made detachable and attachable, and the mode (product development) in which a user replaces the elastic soft skin portion in accordance with preference (hardness or the like) of the user, for example, is enabled.

Further, depending on the specific shape of the mounting structure, the mounting structure (a reception space) which is formed at the hard bone portion is crushed from the vertical direction at the time of pressure reception, and the internal space is narrowed. Therefore, in a retaining state in which a part of the elastic soft skin portion is accommodated in the space, retention of the elastic soft skin portion can be performed reliably.

Note that when the elastic soft skin portion is made detachable and attachable, if a rib (an operation piece) for detachment is provided at the elastic soft skin portion, in addition to the above described mounting structure, a detaching and attaching operations can be performed more easily.

Further, if the above described mounting structures are provided at both of the upper and lower end edges of the hard bone portion and the elastic soft skin portion, the elastic soft skin portion generates extension by which the elastic soft skin portion is pulled vertically, as the inclination angle of the face of the hard bone portion becomes larger by bending to the lateral side of the sole, of the hard bone portion at the time of pressure reception, so that action of the extension and contraction is enhanced to contribute to impact absorption and restoration. Further, the wall thickness of the elastic soft skin portion can be formed to be smaller, and it can be noticed that the elastic soft skin portion remarkably bulges.

Further, if at least a part of the elastic soft skin portion is not in contact with the outer surface of the hard bone portion at the time of no load, it can be noticed that the elastic soft skin portion which is in contact with the hard bone portion generates bulging remarkably, by using a difference in bending (curving) deformation of the hard bone portion and the elastic soft skin portion at the time of pressure reception. Consequently, the presence of the elastic soft skin portion which is often formed of the shock absorbing member of gel or the like can be more effectively made appealing.

Further if the hard bone portion and the elastic soft skin portion are formed to bend more easily toward the bottom face side or the rear side of the shoe, deformation easiness does not become uniform, so that while impact at the time of landing on the ground is absorbed by deformation of the hard bone portion and the elastic soft skin portion, the deformation can be used as the repulsive force at the time of kicking out, and can be converted into smooth movement (motion) of the foot. As a matter of course, a bottoming feeling that can occur when importance is put on only the shock absorbing characteristic can be also prevented, and contribution can be made to enhancement of stability.

Further, if the hard bone portion and the elastic soft skin portion are formed so that the height dimensions become gradually smaller toward the front side or the load shift direction at the time of pressure reception, the height dimensions are not uniform, so that the weight of the wearer easily shifts to the lower side from the higher side, and movement (motion) of the foot at the time of kicking out and the load shift (weight shift) can be easily performed.

Further, if the hard bone portion and the elastic soft skin portion include the guide structure that guides the received pressure load to the front side of the shoe or the load shift direction at the time of pressure reception, movement (motion) of the foot at the time of kicking out can be smoothly performed, the load shift (weight shift) from landing of the wearer to kick-out is easily performed.

Further, if the auxiliary element that receives a part of the received pressure load is provided inside the hard bone portion, the load acting on the hard bone portion and the elastic soft skin portion can be decreased (dispersion). Accordingly, the bending degree of the hard bone portion to the lateral side of the sole, and the bulging degree of the elastic soft skin portion to the lateral side of the sole by extension can be adjusted.

BRIEF DESCRIPTION OF DRAWINGS

FIG. 6 is a side sectional view skeletally showing an embodiment in which a mounting structure that holds a part of an elastic soft skin portion is formed in an outer surface of the hard bone portion.

FIG. 7 shows explanatory views showing a state in which the hard bone portion which is not in contact with the elastic soft skin portion at a time of no load deforms to extend to a lateral side of a sole at a time of pressure reception to contact the elastic soft skin portion, and with this, the elastic soft skin portion deforms to bulge to the lateral side of the sole.

FIG. 10 is a side view showing an embodiment in which the hard bone portion and the elastic soft skin portion are formed so that height dimensions become gradually smaller toward a shoe front side.

FIG. 11 shows embodiments including guide structures that guide the received pressure load to proper directions, in the hard bone portions and the elastic soft skin portions, FIG. 11(*a*) is an explanatory view in which as the guide structure, flexible portions in the hard bone portion are formed so that bending degrees (including curving) of sections thereof become gradually larger toward a shoe rear side, for example, when the flexible portions in the hard bone portion are seen in a vertical section, and FIG. 11(*b*) is an explanatory view in which as the guide structure, slits as a bending promotion structure are formed obliquely or in a spiral shape with respect to a pressure receiving direction (a direction in which a received pressure load acts).

FIG. 12 is a sectional view showing an embodiment in which an auxiliary element that absorbs impact (a received pressure load) by compression deformation of itself at a time of pressure reception is provided in an inner peripheral side of the hard bone portion.

FIG. 14(*a*) is an explanatory view showing an embodiment in which when a bending promotion structure such as slits are formed in a flexible portion of the hard bone portion, middle portions thereof are connected to enhance strength and durability of the flexible portion, FIG. 14(*b*) is an explanatory view showing an embodiment in which the hard bone portion is formed to be partially in two layers on an outer peripheral side like a belt carrier (a belt loop), and the elastic soft skin portion is passed between the two layers to achieve mounting of the elastic soft skin portion, FIG. 14(*c*) is an explanatory view showing an embodiment in which the configurations in FIG. 14(*a*) and FIG. 14(*b*) described above are made to coexist, and FIG. 14(*d*) is a sectional view showing an embodiment in which a sectional shape of the hard bone portion is formed into a Σ (sigma) shape.

REFERENCE SIGNS LIST

Figures 1, 1A:
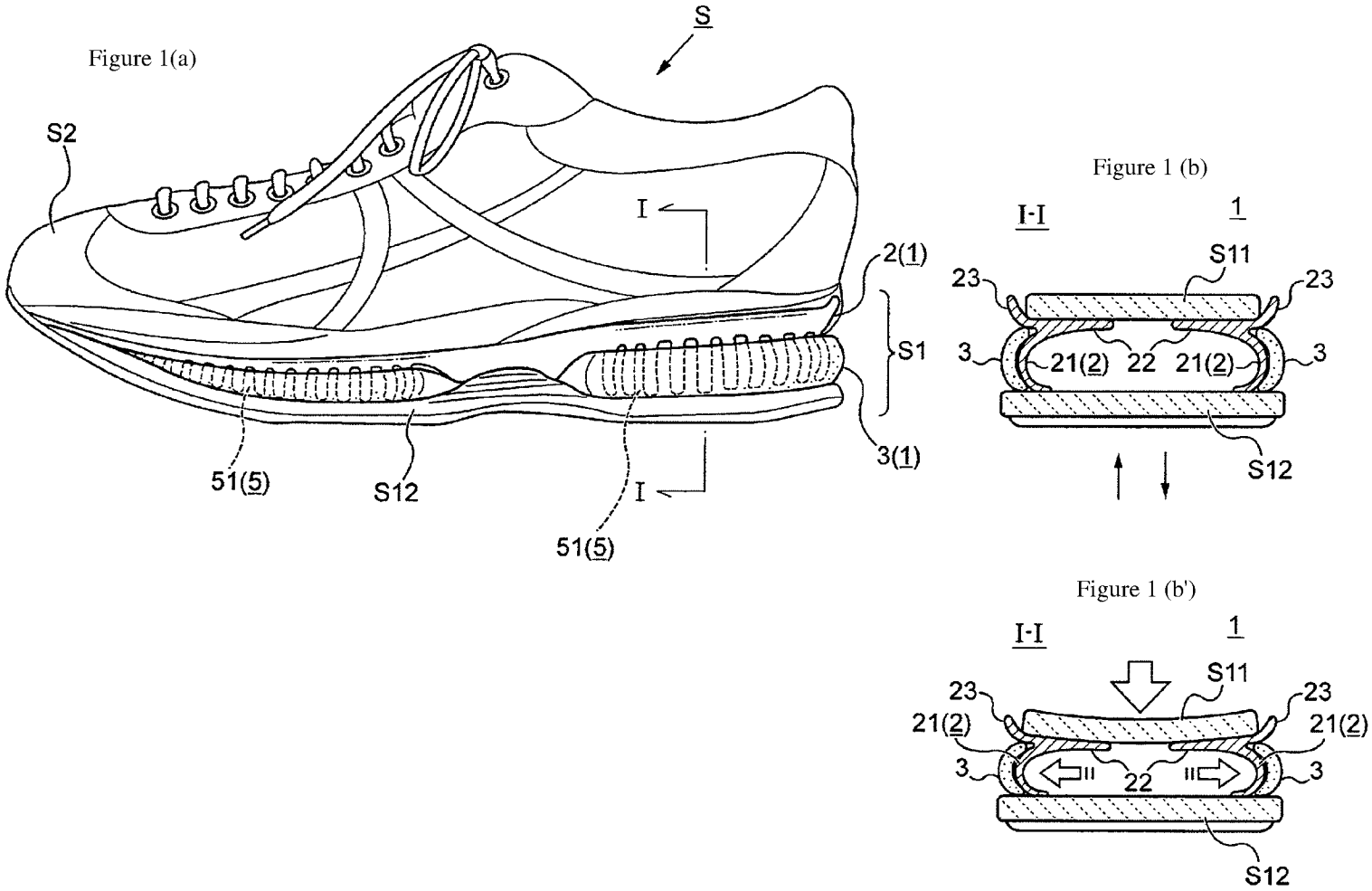
FIG. 1 includes a side view (a) showing an example of a shoe including a shock absorbing structure of the present invention, a sectional view (b) of a shock absorbing structure at a time of no load in line I-I in FIG. 1(*a*), and a sectional view (b') of the shock absorbing structure at a time of pressure reception in line I-I in FIG. 1(*a*).

1 Shock absorbing structure
2 First shock absorbing member (Hard bone portion)
3 Second shock absorbing member (Elastic soft skin portion)
4 Auxiliary element
5 Bending promotion structure
6 Protrusion emphasizing structure
7 Mounting structure
8 Guide structure
21 Flexible portion
22 Sole receiving portion
23 Return
24 Non-deformation portion
5 Bending promotion structure
51 Slit
52 Groove (rib)
53 Small hole
6 Protrusion emphasizing structure
61 Convex portion
62 Concave portion
7 Mounting structure
71 Reception space
72 Fitting portion
73 Engagement portion
74 Operation piece
S Footwear (shoe)
S1 Sole
S11 Insole
S12 Outsole
S2 Upper

DESCRIPTION OF EMBODIMENTS

Modes for carrying out the present invention include what will be described in the following embodiments as some of the modes, and also further include various methods that can be improved within the technical idea of the present invention.

Embodiments

A shock absorbing structure (a shock absorbing structure for a sole side face) of the present invention is incorporated in footwear such as a shoe S, for example, as shown in FIG. 1 as an example, absorbs impact that is applied to a leg of a person wearing (a wearer) the shoe S, and also smoothly converts impact which cannot be completely absorbed, into a kicking-out motion of a foot. Here, in the present embodiment, as a product in which the shock absorbing structure is incorporated, a shoe (sports shoe) S is mainly shown, but as footwear other than this, sandals and the like are cited, for example.

Hereinafter, the shoe S in which the shock absorbing structure is incorporated will be described first.

The shoe S is formed by joining an upper S2 which covers an instep of a foot or the like to a sole S1 to be a ground contact part, as shown in FIG. 1 described above. The above described shock absorbing structure is provided between an insole S11 and an outsole S12 in the sole S1, for example.

Note that when the shock absorbing structure is incorporated in the shoe S, it is desired that the shock absorbing structure itself is installed so as to be visible from outside as much as possible for the purpose of making shock absorbing performance strongly appealing, and from a viewpoint of improvement in design or the like, and for this purpose, FIG. 1 described above illustrates a mode in which the shock absorbing structure is mounted to be visible from a substantially entire outer peripheral edge of a sole side face of the shoe S. However, when the shock absorbing structure is incorporated in the sole S1, it is also possible to form a reception space that accommodates a shock absorbing structure 1, inside the sole S1 in advance, for example, (not illustrated), and after accommodating the shock absorbing structures 1 in the reception space, close the reception space with a translucent member (a transparent member) to make the shock absorbing structure visible from outside.

Hereinafter, the shock absorbing structure 1 which realizes the shock absorbing structure of the present invention will be described.

While the shock absorbing structure (the shock absorbing structure 1) of the present invention has a main object to absorb impact when a compression load is applied (referred to as a time of pressure reception, and a compression load at this time will be referred to as a received pressure load) in such a manner that the shock absorbing structure is sandwiched by the insole S11 the outsole S12, as at the time of landing of the sole, for example, the shock absorbing structure is configured to smoothly shift an impact force which cannot be completely absorbed to a kicking-out motion of a foot of a wearer as a repulsive force, at a proper stage in which the shock absorption advances (before causing a bottoming phenomenon). Note that the aforementioned received pressure load is mainly an impact load, but also includes a static load.

As shown in FIG. 1 as an example, the shock absorbing structure 1 as above is formed of a first shock absorbing structure or hard portion (referred throughout this disclosure as a "hard bone portion") 2 that is provided in such a manner as to stride and be positioned between the insole S11 and the outsole S12, and deforms in such a manner as to extend to a lateral side of a sole at a time of pressure reception, the later side being an outer side of the sole, and second shock absorbing structure or elastic portion (referred throughout the disclosure as an "elastic soft skin portion") 3 provided in a rubber ring shape, for example, in an outer peripheral side of the hard bone portion 2, as main components.

In this manner, the shock absorbing structure 1 of the present embodiment is provided on an outer peripheral face of the sole S1, for example, (not necessarily on an entire periphery of the sole S1), and is provided in a position of a midsole.

At a time of pressure reception, the hard bone portion 2 receives the received pressure load and undergoes bending deformation so as to extend to the lateral side of the sole (an outer side of a sole side face), and by receiving the deformation, the elastic soft skin portion 3 undergoes elastic deformation in a height direction in such a manner as to bulge to the lateral side of the sole to absorb the received pressure load. Thereafter, with decrease in the received pressure load (referred to as decompression), the elastic soft skin portion 3 undergoes elastic deformation in such a manner as to contract inward of the sole this time, and by receiving this, the hard bone portion 2 which is extended to the lateral side of the sole is restored to an initial state. Here, the height direction refers to a thickness direction of the hard bone portion 2 corresponding to a thickness direction of the inner sole S11 (or the outer sole S12).

Due to a deformation mode as above, the elastic soft skin portion 3 itself causes bulging deformation from outside, and even if the elastic soft skin portion 3 is formed into an extremely thin film shape, for example, presence of the elastic soft skin portion 3 which is often formed of a shock absorbing member including gel or the like, and shock absorbing performance of the shoe S by extension can be effectively made appealing.

Further, since the deformation structure like this is adopted, the elastic soft skin portion 3 performs an action of restricting deformation (outward extension) of the hard bone portion 2.

Hereinafter, the hard bone portion 2 and the elastic soft skin portion 3 will be further described.

First, the hard bone portion 2 will be described.

The hard bone portion 2 causes bending deformation so as to extend to an outer peripheral direction by the received pressure load which is applied at the time of pressure reception as described above, and therefore, the hard bone portion 2 is formed from a material that does not cause (or hardly causes) compression deformation which simply reduces a height dimension at the time of pressure reception and decreases a volume. More specifically, application of a molded product of a synthetic resin is realistic, but a foam or the like is not suitable because a foam or the like is directly compressed at the time of pressure reception. Note that as an example of the synthetic resin, a polyether block amide copolymer (for example, PEBAX (registered trademark)) or the like may be used.

In this connection, the elastic soft skin portion 3 which is provided at an outer side of the hard bone portion 2, may include a viscoelastic material such as a gel material, various rubber materials or the like (a shock absorbing member of a gel or the like). The elastic soft skin portion 3 has a lower hardness than the hard bone portion 2, has a high tensile strength, contracts in a radial direction by its own elasticity, and also restores the hard bone portion 2 into an initial state at the time of decompression when the received pressure load decreases. As a matter of course, by changing the hardness or the like of the elastic soft skin portion 3, not only the shock absorbing action (bulging deformation) of the elastic soft skin portion 3 is changed, but also the restriction force that restricts deformation of the hard bone portion 2 is changed.

As shown in a sectional view in FIG. 1 described above as an example, the hard bone portion 2 is formed by including a flexible portion 21 that is formed into a curved shape in vertical sectional view, and deforms in such a manner as to extend to a lateral side of a sole at the time of pressure reception, and a sole receiving portion 22 that forms a flat shape in an upper portion thereof, and supports an end edge portion of the insole S11.

Further, in the present embodiment, a return 23 to an upper side is formed arbitrarily at an outer peripheral end of the sole receiving portion 22 and is formed to cover a lower end peripheral edge of the insole S11.

Note that the return 23 is formed in a portion facing a lateral side of the sole. That is, in a site where the return 23 would slip under (a site where the return 23 least partially slips in) the insole S11, the return 23 is not formed to avoid contact with the insole S11 and may contact the outer edges of the insole S11 (refer to FIG. 2(*a*)).

Figure 2:
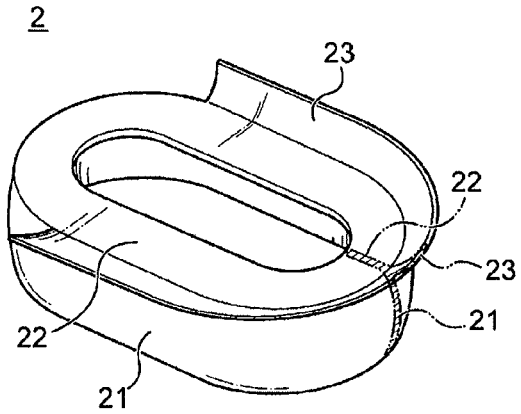
FIG. 2 includes a perspective view (a) showing an example of a hard bone portion formed into a ring shape (an endless shape), a perspective view (b) showing an example of a hard bone portion formed into a fragment shape, and a side view (c) showing a state in which a shock absorbing structure in a fragment shape is mounted to a midsole portion of a shoe.
Figure 2:
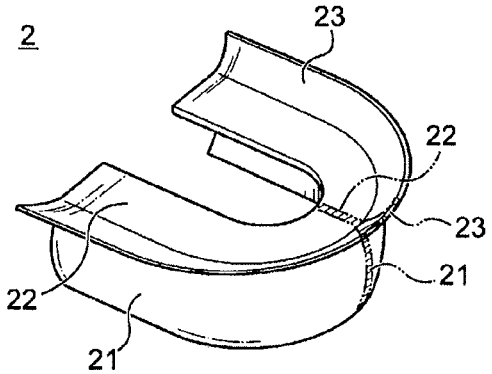
Figure 2:
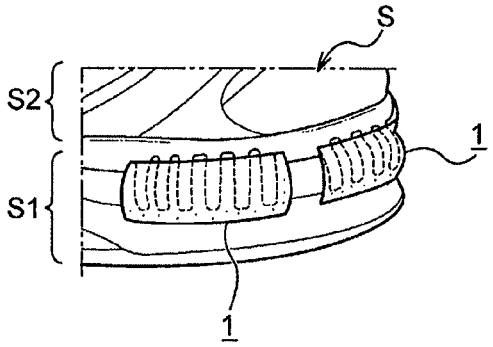

As shown in FIG. 2(*a*) as an example, the hard bone portion 2 can be formed into an endless ring shape (such as a ring or stadium shape) in which the flexible portion 21 and the sole receiving portion 22 continue at 360 degrees. In this case, the hard bone portion 2 includes an action of extension and contraction in a radial direction similarly to a rubber ring, and this significantly contributes to impact absorption and restoration. When the hard bone portion 2 is ring-shaped, a diameter dimension of an inner side of the elastic soft skin portion 3 is made a slightly smaller dimension than a diameter dimension of an outer side of the hard bone portion 2, whereby an action of extension and contraction of the elastic soft skin portion 3 can be adjusted.

As a matter of course, the hard bone portion 2 does not necessarily have to be formed into a complete ring, but as shown in FIG. 2(*b*), for example, the hard bone portion 2 may be formed into a fragment shape being a portion of the ring shape (in this case, a "U" shape in plan view) where two fragment shapes form opposing end portions. In this case, by fixing both of the end portions, extension and contraction of the two end portions occurs similar to the complete ring shape, and similarly contributes to impact absorption and restoration.

In this connection, when the hard bone portion 2 is formed into a fragment shape, the hard bone portion 2 is mounted along a side face of the sole S1 (midsole) as shown in FIG. 2(*c*), for example. In this way, the hard bone portion 2 may be formed into not only a ring shape, but also in a fragment shape, in more detail, a "U" shape in plan view, a part of a circular arc, a straight bar shape or the like. Here, a ring shape, a U-shape or a circular arc is referred to as "a circular-arc shape", except for a straight bar shape.

Note that when the hard bone portion 2 is formed into the ring-shape as shown in FIG. 2(*a*) described above, it is desirable to fit the elastic soft skin portion 3 onto the hard bone portion 2 from below prior to the outsole S12 being joined to the insole S11, and thereafter fix the elastic soft skin portion 3 fitted onto the hard bone portion 2 to the sole S1 with an adhesive to easily incorporate the shock absorbing structure 1 into the sole S1.

Further, the hard bone portion 2 includes a bending promotion structure 5 that causes the flexible portion 21 to extend easily (expand easily) outward (to the lateral side of the sole) at a time of pressure reception.

Figure 3:
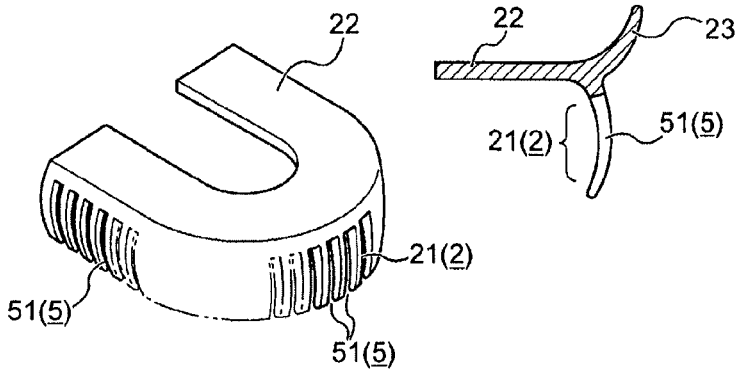
FIG. 3 includes views showing various bending promotion structures in the hard bone portion, FIG. 3(*a*) shows a skeletal perspective view and a sectional side view of an example in which slits are formed as the bending promotion structure, and a lower end edge of a flexible portion is formed into a cut-off state by the slits, FIG. 3(*b*) shows a skeletal perspective view and a sectional side view of an example in which slits are formed as the bending promotion structure, and a lower end edge of the flexible portion is not cut off by the slits, FIG. 3(*c*) is a sectional side view in which a flexible portion is partially formed into a thin-walled shape, and the thin-walled portion is made the bending promotion structure, and FIG. 3(*d*) is a sectional side view in which small holes are provided in a flexible portion as the bending promotion structure.
Figure 3:
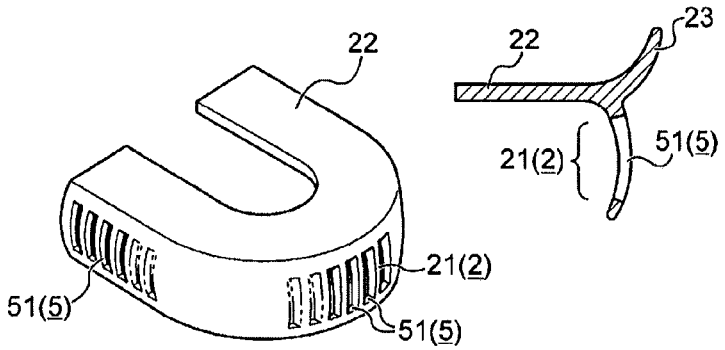
Figure 3:
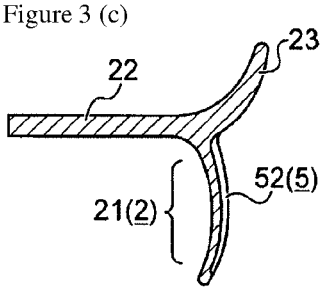
Figure 3:
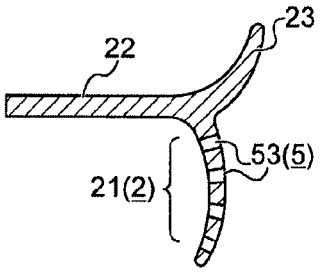

As the bending promotion structure 5, slits 51 which are alternately cut out to be substantially along a vertical direction (a pressure receiving direction) are cited as shown in FIG. 3(*a*) as an example. Here, the slits 51 are illustrated in a state where opening lower end portions are completely cut off (a so-called comb shape), but as shown in FIG. 3(*b*), for example, the lower end portions of the respective slits 51 are connected (not cut off), and opening portions (slits 51) may be opened in window shapes in the flexible portion 21 (this is also included in the slit 51).

Note that the slits 51 the lower end portions of which are cut off as shown in FIG. 3(*a*) present a state which can be said as a comb shape (a curved comb shape), and this is more effective in the point that individual comb teeth (vertical lattice) deform so to bulge in a radial shape especially at the time of pressure reception, and it seems as if the elastic soft skin portion 3 itself bulged outward.

Further, as the bending promotion structure 5 other than the slit 51, a configuration in which a portion corresponding to the above described slit 51 is formed into a groove 52, that is, a thin-walled shape is also possible, as shown in FIG. 3(*c*), for example. In this case, similarly to the above described slit 51, the thin-walled groove 52 may be formed to reach the lower end portion of the flexible portion 21, or may be stopped in a midway portion.

Further, as another bending promotion structure 5, a plurality of small holes 53 can be provided by being bored in the flexible portion 21, as shown in FIG. 3(*d*), for example.

In this connection, the groove 52 as the bending promotion structure 5 as described above also can be said as a rib when the groove 52 is viewed from a different angle, and a wall thickness dimension of a site where no groove 52 is formed is considered as large. Since it is assumed that production of the hard bone portion 2 is achieved by molding of a synthetic resin as described above, a difference in the wall thickness like this is sufficiently conceivable. Consequently, a configuration in which the wall thickness of the hard bone portion 2 (the flexible portion 21) is made partially large (rib formation) facilitates deformation of the site where no rib is formed, and therefore can be also said as a kind of the bending promotion structure 5.

The slit 51 and the groove 52 can adjust easiness of extension of the hard bone portion 2 (the flexible portion 21) by a width dimension at a time of formation. Further, in the case of the small holes 53, easiness of extension of the flexible portion 21 can be adjusted by a density, a size and the like of the small hole 53.

Figure 4:
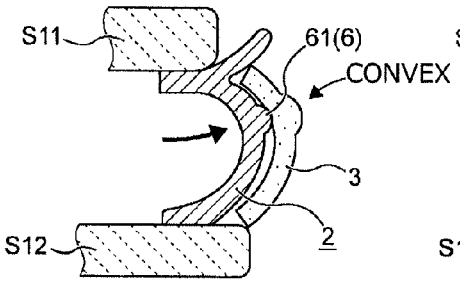
FIG. 4 includes views showing a protrusion emphasizing structure in the hard bone portion, FIG. 4(*a*) is a sectional side view in which a convex portion formed on an outer surface of the hard bone portion is made the protrusion emphasizing structure, and FIG. 4(*b*) is a sectional side view in which a concave portion formed in an inner side portion of the hard bone portion is made the protrusion emphasizing structure.
Figure 4:
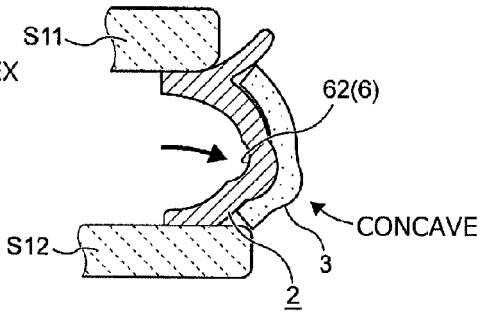

As shown in FIG. 4 as an example, a protrusion emphasizing structure 6 that protrudes the elastic soft skin portion 3 to an outermost side can be provided at a part of a vertical section in the hard bone portion 2 (the flexible portion 21). Thereby, the elastic soft skin portion 3 causes extension deformation in such a manner as to protrude to the outermost side in a site where the protrusion emphasizing structure 6 is formed at the time of pressure reception, so that as compared with a case where the elastic soft skin portion 3 substantially uniformly bulges and deforms, a most protruded portion is emphasized, a direction in which the elastic soft skin portion 3 is to restored is added at the time of decompression, and visual interest can be produced.

Note that as the protrusion emphasizing structure 6, a dot-shaped convex portion (protrusion) 61 that is formed on an outer surface of the flexible portion 21 is cited as shown in FIG. 4(*a*) as an example, but the convex portion 61 also can be protruded in a line shape.

In this connection, the protrusion emphasizing structure 6 is not necessarily formed only on the outer surface of the flexible portion 21, but also can be formed in an inner side portion of the flexible portion 21, as shown in FIG. 4(*b*), for example, and the inner side portion is formed into a concave shape here (this is referred to as a concave portion 62). That is, in this case, the hard bone portion 2 (the flexible portion 21) bends while strongly curving in the concave portion 62 at the time of pressure reception, and thereby causes the elastic soft skin portion 3 to bend strongly outward in the site (bulging is strongly emphasized). As a matter of course, in this case, the concave portion 62 as the protrusion emphasizing structure 6 can be formed into a dot shape or a line shape similarly to the above described convex portion (protrusion) 61.

Figure 5:
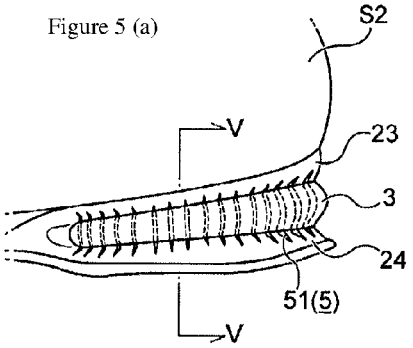
FIG. 5 includes a side view (a) showing a shock absorbing structure in which a non-deformation portion is formed in the hard bone portion, a sectional view (b) of the shock absorbing structure in line V-V in FIG. 5(*a*), and an enlarged side view (c) showing that a start position of bending deformation of the hard bond portion can be controlled by the non-deformation portion.
Figure 5:
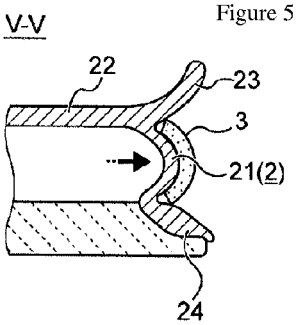
Figure 5:
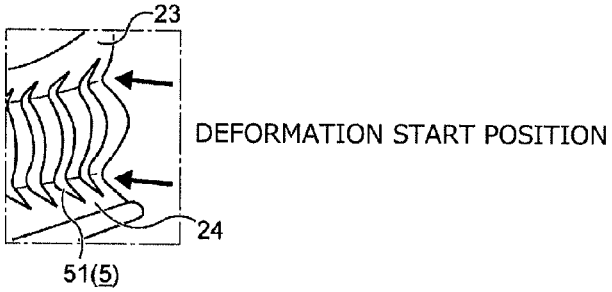

Further, in the hard bone portion 2, a part (this will be referred to as a non-deformation portion 24) that does not undergo bending deformation extending to the lateral side of the sole at the time of pressure reception can be formed in at least one of both upper and lower end edges in a vertical section, as shown in FIG. 5 as an example.

This is an idea of starting bending deformation from a midway portion instead of bending the hard bone portion 2 (the flexible portion 21) entirely from vicinities of both upper and lower ends at the time of pressure reception, in other words, an idea of being capable of adjusting a bending start position by the non-deformation portion 24. In this connection, in FIG. 5 described above, the non-deformation portion 24 is formed by devising the sectional shape of the hard bone portion 2, reducing a vertical dimension of the slit 51 as the bending promotion structure 5 (reduction in dimension) and the like. Besides, the non-deformation portion 24 can be also formed by fitting a cover member to a part which is not desired to be bulged in the elastic soft skin portion 3 from outside, as a matter of course, and the cover member like this will be described later.

If magnitudes of the received pressure loads are the same, the present embodiment which undergoes bending deformation from the midway portion has a smaller radius of curvature at a time of extending to the lateral side of the sole than the case of causing bending deformation entirely, and bulging deformation is visually observed more remarkably, so that an extension degree can be adjusted by the bulging start position.

Further, the configuration like this is also effective (applicable) when the hard bone portion 2 (the shock absorbing structure 1) is formed into a shape with a plurality of stages (a so-called multi-stage shape) in vertical sectional view. Furthermore, various variations can be developed depending on from where bulging deformation is performed (that is, which is set as the non-deformation portion 24) in the single hard bone portion 2.

Further, as shown in FIG. 6 as an example, in the hard bone portion 2, a mounting structure 7 that holds a part of the elastic soft skin portion 3 can be provided in at least one of both upper and lower end edges of the outer surface.

As the mounting structure 7, a part of the hard bone portion 2 may be opened in a circular shape in section (three-dimensionally, a spherical opening) as also shown in FIG. 6, or such an opening may be formed into a linear shape (an opening space like this is referred to as a reception space 71).

As a matter of course, when the mounting structure 7 (the reception space 71) is formed in the hard bone portion 2, a fitting portion 72 corresponding to the above described reception space 71 is also formed at the elastic soft skin portion 3, as the mounting structure 7.

The above described technical idea of forming the mounting structure 7 (the reception space 71) in a part of the hard bone portion 2 is an idea of fixing the elastic soft skin portion 3 to the hard bone portion 2 without using an adhesive or the like. Accordingly, even after the shoe S is shipped to the market, the elastic soft skin portion 3 can be freely detached and attached, and a mode (product development) is enabled, in which, for example, a user replaces the elastic soft skin portion 3 for himself or herself in accordance with his or her preference (hardness, a shock absorbing characteristic or the like).

Further, since the mounting structure 7 (the reception space 71) which is formed in the hard bone portion 2 is crushed from the vertical direction at the time of pressure reception, and a space interior is narrowed, although it depends on the shape (a fitting state) of the mounting structure 7, fixation and holding of the elastic soft skin portion 3 are performed firmly and reliably in a fixed state where a part of the elastic soft skin portion 3 (the fitting portion 72) is accommodated in the reception space 71.

Further, when at least one of the elastic soft skin portion 3 is mounted in such a manner as to cover an upper end edge to a lower end edge of the hard bone portion 2 continuously, and the above described mounting structures 7 are provided at upper end edges and lower end edges of the hard bone portion 2 and the elastic soft skin portion 3, the elastic soft skin portion 3 follows bending of the hard bone portion 2, and is pulled vertically (extended) as compared with a case where both of the ends are not fixed, when the elastic soft skin portion 3 is pushed by extension of the hard bone portion 2, extension to the lateral side of the sole can be visually recognized more remarkably. Further, contribution is made to impact absorption and restoration by enhancing actions of extension and contraction, and since it can be noticed that the elastic soft skin portion 3 significantly bulges by making the wall thickness smaller, shock absorbing performance of a shoe sole can be sufficiently made appealing.

Hereinafter, the elastic soft skin portion 3 will be further described.

As described above, the elastic soft skin portion 3 is provided at an outer peripheral side of the aforementioned hard bone portion 2, and besides the mode in which the elastic soft skin portion 3 is in contact with the hard bone portion 2 on an entire surface at the time of no load, a mode in which the elastic soft skin portion 3 is partially in contact with the hard bone portion 2, and a mode in which the elastic soft skin portion 3 is not in contact with the hard bone portion 2 can be adopted.

That is, the hard bone portion 2 undergoes bending deformation in such a manner as to extend to the lateral side of the sole at the time of pressure reception, even in a case where the elastic soft skin portion 3 is hardly in contact with the hard bone portion 2 at the time of no load (in a so-called floating state) as shown in FIG. 7(*a*), for example, and in a case where the elastic soft skin portion 3 is in contact with the hard bone portion 2 only at both upper and lower end portions at the time of no load, as shown in FIG. 7(*b*), for example, and therefore, at least a part of the hard bone portion 2 contacts the elastic soft skin portion 3, whereby the elastic soft skin portion 3 undergoes elastic deformation in such a manner as to bulge to the lateral side of the sole, as shown in FIG. 7(*c*). At this time in a contact site, the elastic soft skin portion 3 undergoes elastic deformation in such a manner as to bulge to the lateral side of the sole by having a larger radius of curvature than the hard bone portion 2, and therefore, presence of the elastic soft skin portion 3 which is often formed of the shock absorbing member of a gel or the like, in particular, even in a case where the elastic soft skin portion 3 is formed into a thin film shape, the presence of the small amount of elastic soft skin portion 3 can be effectively made appealing.

Although in FIG. 7(*c*), bulging deformation of the elastic soft skin portion 3 is shown in such a manner as to protrude (curve) significantly at one point (seems to be the same as the above described protrusion emphasizing structure 6 in this sense), here it is mainly shown that the elastic soft skin portion 3 contacts the hard bone portion 2 at the time of pressure reception and causes bulging deformation.

Further, in the elastic soft skin portion 3, the mounting structure 7 which achieves mounting to the hard bone portion 2 can be provided in at least a part of the inner side surface.

Figure 8:
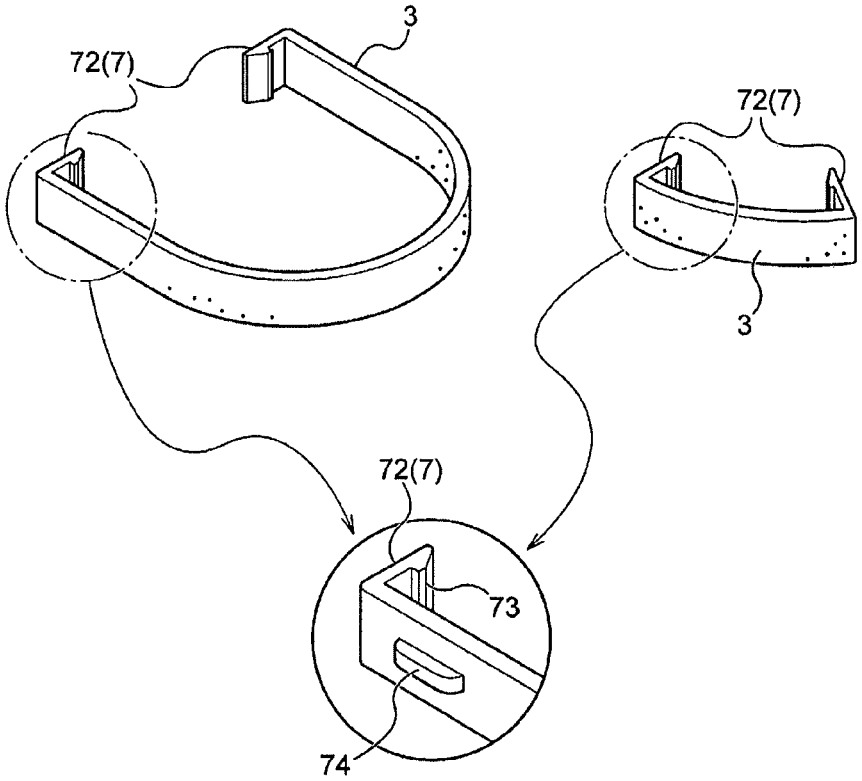
FIG. 8 shows a view skeletally showing an embodiment in which a mounting structure that achieves mounting to the hard bone portion is formed in an inner surface of the elastic soft skin portion, and a perspective view additionally showing an embodiment in which a hook-shaped engagement portion and an operation piece for detachment are further provided at the mounting structure.

Here, as the mounting structure 7 of the elastic soft skin portion 3, a fitting portion 72 such as a claw or the like that is formed to protrude toward the hard bone portion 2 is cited, as shown in FIG. 8, for example, and here, the claws (the fitting portions 72) are illustrated to be provided at both left and right ends of the elastic soft skin portion 3.

When the mounting structure 7 like this is adopted, the reception space 71 (the mounting structure 7) in which the above described claw (the fitting portion 72) is fitted is naturally formed in the hard bone portion 2 as described above, but the claws (the fitting portions 72) of the elastic soft skin portion 3 may be fitted in the slits 51 (the bending promotion structure 5) of the hard bone portion 2. That is, in this case, a part of the slit 51 (the bending promotion structure 5) performs the action of the mounting structure 7 (the reception space 71) for fixing the elastic soft skin portion 3 to the hard bone portion 2.

Further, as shown in FIG. 8 in addition, for example, if a hook-shaped engagement portion 73 is formed at a tip end of the above described claw (the fitting portion 72), the elastic soft skin portion 3 fixed to the hard bone portion 2 can be prevented from disengaging, and a fixing force can be reinforced.

Further, by adopting the mounting structure 7 like this, the elastic soft skin portion 3 can be mounted to an outer peripheral side of the hard bone portion 2 without using an adhesive or the like, and a mode of making the elastic soft skin portion 3 detachable and attachable can be easily adopted. Accordingly, the user can customize the shock absorbing performance on site in accordance with his or her preference (hardness and the like), conditions (change in running ability and walking ability following edema of feet and fatigue) of feet over time by running and walking for long hours such as a long distance marathon, for example. Development of a product which replaces the elastic soft skin portion 3 in accordance with needs as above is enabled.

When the elastic soft skin portion 3 is configured to be detachable and attachable, if a rib for detachment (for a detaching and attaching operations) is formed at the elastic soft skin portion 3, in addition to the above described fitting portions 72, as shown in FIG. 8 as an additional example, a detaching and attaching operations of the elastic soft skin portion 3 can be performed more easily (the rib is referred to as an operation piece 74).

In this connection, when the elastic soft skin portion 3 is made attachable and detachable, the elastic soft skin portion 3 is generally formed into a fragment shape (a non-ring shape), but even if the elastic soft skin portion 3 is formed into a ring shape (a rubber ring shape), the claw (the fitting portion 72) can be formed at the elastic soft skin portion 3, and in that case, the claw also functions to prevent deviation in restoration to the initial position.

Next, a cooperation variation of the hard bone portion 2 and the elastic soft skin portion 3 will be described.

First, at least one of the aforementioned hard bone portion 2 and elastic soft skin portion 3 can be formed to have a structure which is more easily deformed at the time of pressure reception toward the bottom face side or the rear side of the shoe S. This is a kind of an idea of making deformation easiness (bending easiness) of the shock absorbing structure 1 differ in according with sites of a foot sole.

Figure 9:
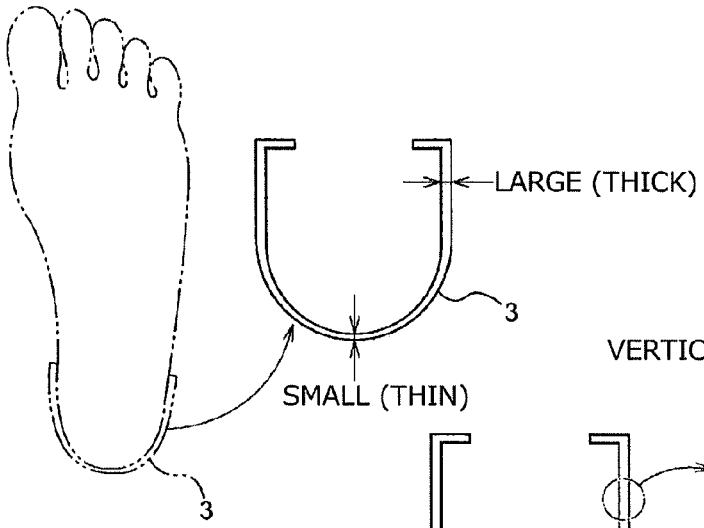
FIG. 9 shows embodiments in which deformation easiness of the hard bone portion and the elastic soft skin portion is caused to differ in accordance with sites, FIG. 9(*a*) shows a skeletal plan view showing an embodiment in which a wall thickness dimension (a wall thickness dimension seen from a plane) of the elastic soft skin portion is made gradually smaller toward a shoe rear side, and deformation is made easier toward the shoe rear side, FIG. 9(*b*) is an explanatory view showing an embodiment in which a wall thickness dimension (a wall thickness dimension seen in a vertical sectional state) of the elastic soft skin portion is made gradually smaller toward a shoe bottom face side, and deformation is made easier toward the shoe bottom face side, FIG. 9(*c*) is a sectional side view showing an embodiment in which a wall thickness dimension of a flexible portion in the hard bone portion is formed to be smaller (thinner) toward a lower side, and deformation is made easier toward a shoe bottom face side, and FIG. 9(*d*) is a sectional side view showing an embodiment in which when small holes as a bending promotion structure are formed in the hard bone portion, the small holes are formed in only a lower side of a flexible portion, and deformation is made easier toward a shoe bottom face side, and FIG. 9(*e*) is a sectional side view showing an embodiment in which when slits are formed as a bending promotion structure in the hard bone portion, the intervals of the slits are formed to be wider toward a lower side, and deformation is made easier toward a shoe bottom face side.
Figure 9:
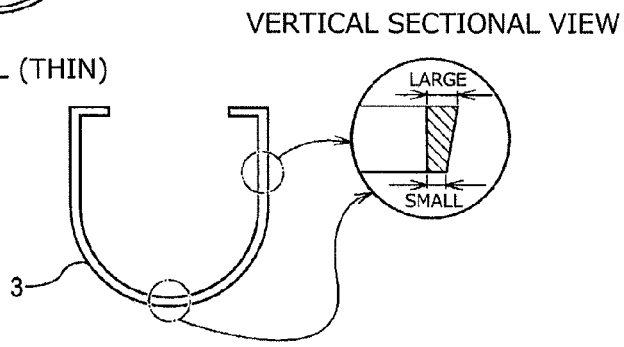
Figure 9:
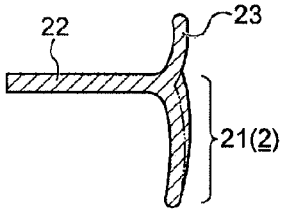
Figure 9:
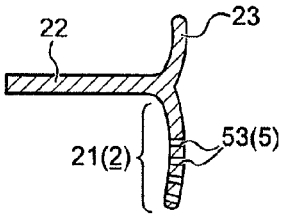
Figure 9:
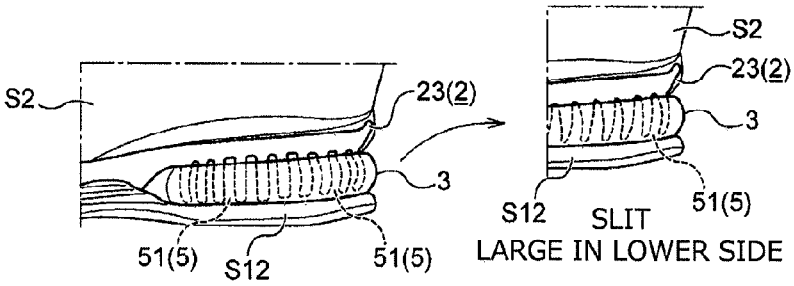

More specifically, as the structure which is more easily deformed toward the rear side of the shoe S, making the wall thickness dimension (the wall thickness dimension seen from a plane) of the elastic soft skin portion 3 gradually smaller toward the rear side of the shoe can be cited, as shown in FIG. 9(*a*), for example. That is, the elastic soft skin portion 3 is more easily deformed toward the rear side where the wall thickness dimension is small.

Further, as another structure which is more easily deformed toward the bottom face side of the shoe S, forming the wall thickness dimension (the wall thickness dimension seen in a sectional view state) of the elastic soft skin portion 3 smaller toward the bottom face side of the shoe can be cited, as shown in FIG. 9(*b*), for example. That is, an outline at the outer peripheral side is formed to be in an inclined state narrower to a bottom when the elastic soft skin portion 3 is seen in a section. In this case, the elastic soft skin portion 3 is also more easily deformed toward the bottom face side (a lower side) where the wall thickness dimension is small.

As a matter of course, in making easiness of deformation differ, easiness of deformation is not necessarily made to differ in the elastic soft skin portion 3, but also can be made to differ in the hard bone portion 2, and if the wall thickness dimension of the flexible portion 21 in the hard bone portion 2 is formed to be smaller (thinner) toward the lower side as shown in FIG. 9(*c*), for example, the hard bone portion 2 has a structure which is more easily deformed toward the bottom face side of the shoe S.

Further, when the small holes 53 are formed as the bending promotion structure 5 in the hard bone portion 2, as shown in FIG. 9(*d*), for example, the small holes 53 can be formed in only the lower side of the flexible portion 21. In this case, the hard bone portion 2 has the structure which is more easily deformed toward the bottom face side of the shoe S. Even when the small holes 53 are entirely formed in the flexible portion 21 as the bending promotion structure 5, easiness of deformation can be adjusted by formation density of the small holes.

Further, when the slits 51 are formed in the hard bone portion 2 as the bending promotion structure 5, as shown in FIG. 9(*e*), for example, a width of the slit 51 can be formed to be larger toward the lower side. In this case, the hard bone portion 2 also has a structure that is more easily deformed toward the bottom face side of the shoe S. If the slits 51 are formed in only the lower side of the flexible portion 21, instead of being formed in the entire flexible portion 21, the structure that is more easily deformed toward the bottom face side of the shoe S can be realized.

In this way, various configurations in which easiness of deformation is made to differ are assumed, and besides, it is conceivable to give recesses and protrusions partially with ribs or the like.

By the above configuration (to form the hard bone portion 2 and the elastic soft skin portion 3 to be more easily bended toward the bottom face side or the rear side of the shoe S (not to make easiness of deformation uniform)), impact at the time of landing is absorbed by deformation of the hard bone portion 2 and the elastic soft skin portion 3, and the deformation can be used as a repulsive force at the time of kicking out, and can be converted into smooth movement (a motion) of a foot. As a matter of course, a bottoming feeling that can occur when only an impact absorbing characteristic is regarded as important can be prevented, and contribution can be made to enhancement of stability.

Further, the aforementioned hard bone portion 2 and elastic soft skin portion 3 can be formed so that the height dimensions become gradually smaller toward the front side of the shoe S, as shown in FIG. 10, for example. Note that in the drawing, in the front side of the shoe S, a toe side is formed to be low, and a heel side is formed to be high.

Here, a direction in which the height dimension is made small is not only a front side of the shoe S, but also can be set as a load shift direction at the time of pressure reception. When a shoe bottom (the side face) is desired to be designed to have an external appearance where the hard bone portion 2 and the elastic soft skin portion 3 in a plantar arch portion have heights, for example, depending on the design of the shoe bottom (the side face), tuning of bending different from the appearance can be made with the non-deformation portion 24.

The heights of the hard bone portion 2 and the elastic soft skin portion 3 are not made uniform as above, whereby the weight of the wearer can be more easily shifted to a lower side (an inclination direction) from a higher side, and movement (motion) of the foot and a load shift (a weight shift) at the time of kicking out are easily performed.

Further, a guide structure 8 that guides the received pressure load to a front side of the shoe S or the load shift direction at the time of pressure reception can be provided in at least one of the hard bone portion 2 and the elastic soft skin portion 3.

Here, as the guide structure 8, a bending degree (including curving) of the sectional shape of the hard bone portion 2 (the flexible portion 21) is cited, as shown in FIG. 11(*a*), for example. In more detail, the bending degree of the section of the flexible portion 21 is made gradually stronger toward the rear side of the shoe, for example. In this case, the side (the rear side) with a stronger bending degree is more easily deformed, so that a difference occurs as an apparent hardness, and a difference can be given to falling easiness (here, more easily bended toward the shoe rear side).

The guide structure 8 that controls falling easiness can be also realized not only by the sectional shape of the flexible portion 21 or the like, but also by forming a curved line of the hard bone portion 2 seen from a surface to be gradually larger. Further, if the deformation start position of the hard bone portion 2 seen from the surface is changed, the falling direction can be controlled even though the curved line is formed in the same state.

Further, as the other guide structures 8 than the above, the slits 51 as the bending promotion structure 5 can be formed obliquely to the pressure receiving direction (the direction in which the received pressure load acts), or into a spiral shape, as shown FIG. 11(*b*), for example.

In this case, when receiving the received pressure load, the shock absorbing structure 1 acts in such a manner as to rotate (twist) along the formation direction of the slits 51, and therefore the shock absorbing structure 1 can guide the received pressure load along a substantially vertical direction as a rotational motion (contributes to prevention of excessive inward roll and excessive outward roll).

As above, as "guide" in the above described guide structure 8, guides to the various directions are assumed, such as a guide of a load to the shoe front side, a guide to a shearing direction substantially along the pressure receiving direction, a weight shift to an arbitrary direction in a sole face (load guide), and a guide to a twist direction which rotates with the pressure receiving direction as an axis.

In this connection, the configuration shown in FIG. 9 described above (the configuration in which easiness of deformation is made to differ in accordance with the respective portions), the configuration shown in FIG. 10 described above (the configuration in which the height dimension is made gradually smaller) and the like can be said as kinds of the guide structure 8, however, especially in this case, the configuration that can guide even when the height dimensions are the same is mainly shown.

Other Embodiments

Although the present invention has the embodiments described above as an basic technical idea, the following modifications are further conceivable.

First, although in the aforementioned embodiments, the impact by the received pressure load is absorbed by the hard bone portion 2 and the elastic soft skin portion 3, an inside of the hard bone portion 2 of the shoe sole is not specially limited as long as the effects of the present invention are exhibited. That is, it is not denied that an auxiliary element 4 that receives the received pressure load and assists in compression deformation, namely, shock absorption is provided at an inner peripheral side (between the insole S11 and the outsole S12) of the hard bone portion 2, as shown in FIG. 12, for example. Thereby, adhesive strength to the upper sole which is required of the shoe sole (the side face) can be enhanced, and the load which acts on the hard bone portion 2 and the elastic soft skin portion 3 can be reduced (dispersion). Accordingly, the auxiliary element 4 can be said to adjust the bending degree of the hard bone portion 2 to the lateral side of the sole, and by extension the bulging degree of the elastic soft skin portion 3 to the lateral side of the sole. As a matter of course, the auxiliary element 4 is provided not to inhibit deformation of the hard bone portion 2 and the elastic soft skin portion 3 at the time of pressure reception.

Note that as the auxiliary element 4, a spring or the like can be applied, and can be also formed from a sole material of EVA or the like, and in that case, a part of the insole S11 or the outsole S12 may be made the auxiliary element 4.

Further, if coloring is applied to the auxiliary element 4, or the position of the auxiliary element 4 can be moved or selected, appearance through the slits 51 formed in the hard bone portion 2 changes, and the degree of extension of the elastic soft skin portion 3 and the like may be made appealing more positively.

Further, in the aforementioned basic embodiments, the sectional shape of the elastic soft skin portion 3 is illustrated as a bending plate shape (a crescent shape) having a substantially constant thickness dimension, but the shape is not necessarily limited to this, and can be formed into a solid D-shaped sectional shape, as also shown in FIG. 12, for example.

Figure 13:
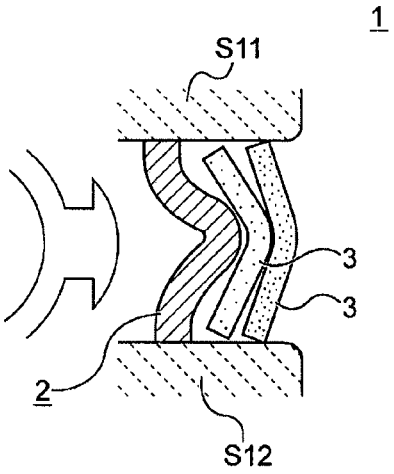
FIG. 13 is an explanatory view showing an embodiment in which the elastic soft skin portions are formed in two layers on an outer peripheral side of the hard bone portion so that impact absorption can be performed in a stepwise manner.

Further, the elastic soft skin portion 3 which is provided at the outer peripheral side of the hard bone portion 2 can be provided (wound) in two layers as shown in FIG. 13, for example. In this case, a mode is such that bending deformation of the hard bone portion 2 to the lateral side of the sole deforms the elastic soft skin portion 3 at an inner side first, and subsequently deforms the elastic soft skin portion 3 at an outer side, and therefore, impact is absorbed in two stages in the elastic soft skin portion 3. Further, bulging deformation of the elastic soft skin portion 3 at the outer side becomes small correspondingly, and therefore, the configuration like this can be said as a configuration that is suitable for the case where the received pressure load applied to the shoe S is originally large excessively.

Further, when the slits 51 or the like as the bending promotion structure 5 are formed in the hard bone portion 2 (the flexible portion 21), connecting middle portions of the slits 51 as shown in FIG. 14(*a*), for example, is cited. Thereby, strength and durability of the hard bone portion 2 which undergoes bending deformation to the lateral side of the sole at the time of pressure reception are enhanced, and even if the hard bone portion 2 is caused to perform extension and contraction to the lateral side of the sole repeatedly, breakage from the slit 51 portion can be effectively prevented. Further, by connecting the middle portions of the slits 51, a restoration motion which returns the hard bone portion 2 which is once expanded can be quickly performed.

In this connection, the idea of connecting the middle portions of the slits 51 is an idea that enhances rigidity of the middle portion of the hard bone portion 2, causes a restoration motion to be performed quickly, and causes the middle connection portion to bend to bulge outward, so that the elastic soft skin portion 3 also has a connection portion extended to be the protrusion emphasizing structure 6. Accordingly, in this sense, a thick-walled portion similar to the above described connection can be also formed in a middle portion in the elastic soft skin portion 3, as also shown in FIG. 14(*a*), for example, whereby the rigidity of the middle portion of the elastic soft skin portion 3 is enhanced, and the restoring motion can be caused to be performed quickly.

Further, the shock absorbing member of gel or the like which is often used as the material of the elastic soft skin portion 3 is generally a material which is difficult to bond. Consequently, a cover member can be further provided on an outer side of the elastic soft skin portion 3, and the cover member can restrict bulging deformation of the elastic soft skin portion 3 (an idea analogous to the above described non-deformation portion 24). That is, while the bonded portion of the elastic soft skin portion 3 is held by the cover member so as not to be excessively deformed, the part other than the bonding portion can be freely bent.

More specifically, as shown in FIG. 14(*b*), the hard bone portion 2 is formed to be in two layers at an inner side and an outer side (formed to be partially in two layers to an outer side like a belt loop, and the hard bone portion 2 at the outer side also serves as the cover member), between the layers (the belt loop), the elastic soft skin portion 3 is passed, and the elastic soft skin portion 3 is fixed to the hard bone portion 2.

In this case, the hard bone portion 2 at the outer side (the cover member) has an action of pressing the elastic soft skin portion 3, and therefore, a large opening portion (the slit 51) is preferably formed in the hard bone portion 2 at the outer side (the cover member) so that the elastic soft skin portion 3 easily bulges. Further, the elastic soft skin portion 3 can be fixed only by being inserted.

Further, if the inner and outer opening portions (the slits 51) of the hard bone portion 2 are alternately disposed, the elastic soft skin portion 3 at the opening portions bulges more easily (more remarkable).

By the configuration like this (the configuration in which the cover member is provided), the shock absorbing member of gel or the like is enabled to be replaced without bonding, a positional deviation of the elastic soft skin portion 3 at the time of restoration, in particular, a positional deviation in the pressure receiving direction which is substantially orthogonal to the winding direction of the elastic soft skin portion 3 can be prevented.

In this connection, the configurations in FIGS. 14(*a*) and 14(*b*) can be adopted at the same time, and this corresponds to a modified example shown in FIG. 14(*c*).

Further, the sectional shape (at the time of no load) of the hard bone portion 2 is not necessarily limited to a bending shape which is protruded outward, and can be formed into a Σ (sigma) shape as shown in FIG. 14(*d*), for example.

In this case, if the elastic soft skin portion 3 is formed in a rectangular shape in section as illustrated, the hard bone portion 2 and the elastic soft skin portion 3 contact at one point of the bent portion, so that the elastic soft skin portion 3 significantly bulges outward at the contact portion at the time of pressure reception, unique shock absorbing performance is obtained, and an effect thereof can be made visually appealing.

FIG. 4(*a*)
#1 CONVEX
FIG. 4(*b*)
#1 CONCAVE
FIG. 5(*c*)
#1 DEFORMATION START POSITION
FIG. 9(*a*)
#1 LARGE (THICK)
#2 SMALL (THIN)
FIG. 9(*b*)
#1 VERTICAL SECTIONAL VIEW
#2 LARGE
#3 SMALL
FIG. 9(*e*)
#1 SLIT
#2 LARGE IN LOWER SIDE
FIG. 11(*a*)
#1 SHOE REAR SIDE
FIG. 14(*a*)
#1 THICK-WALLED PORTION
FIG. 14(*b*)
#1 COVER MEMBER

The invention claimed is:

1. A shock absorbing structure for a shoe sole, comprising:

an insole;

an outsole;

a first shock absorbing member that is provided between the insole and the outsole and curves outwardly along at least a part of a side face of the shoe sole; and a second shock absorbing member that is provided outside of an outwardly curved portion of the first shock absorbing member and has a lower hardness than the first shock absorbing member, wherein the first shock absorbing member pushes the second shock absorbing member to the outer side by deformation when the first shock absorbing member receives pressure, and the second shock absorbing member deforms to the outer side by receiving a force of the deformation of the first shock absorbing member.

2. The shock absorbing structure for a shoe sole according to claim 1, wherein the first shock absorbing member is disposed in a circular arc shape along the outer side of the side face.

3. The shock absorbing structure for a shoe sole according to claim 1, wherein the first shock absorbing member comprises a bending promotion structure that promotes bending deformation which extends to the outer side of the sole when the first shock absorbing member receives pressure.

4. The shock absorbing structure for a shoe sole according to claim 1, wherein a cover member is further provided at an outer side of the second shock absorbing member, and by the cover member, bulging deformation to the outer side of the sole, of the second shock absorbing member is restricted.

5. The shock absorbing structure for a shoe sole according to claim 1, wherein the first shock absorbing member and the second shock absorbing member comprise a mounting structure that holds at least a part of the second shock absorbing member at an outer surface of the first shock absorbing member.

6. The shock absorbing structure for a shoe sole according to claim 5, wherein the second shock absorbing member is mounted so that at least a part of the second shock absorbing member covers the first shock absorbing member continuously from an upper end edge to a lower end edge of the first shock absorbing member, and mounting structures are provided at upper end edges and lower end edges of the first shock absorbing member and the second shock absorbing member, and when the first shock absorbing member receives pressure, the first shock absorbing member bends to the lateral side of the sole, whereby the second shock absorbing member is pulled to upper end and lower end sides.

7. The shock absorbing structure for a sole according to claim 1, wherein at least a part of the second shock absorbing member is not in contact with an outer surface of the first shock absorbing member at a time of no load, at least a part of an inner side surface of the second shock absorbing member contacts the outer surface of the first shock absorbing member when the first shock absorbing member receives pressure, and at a contact site, the second shock absorbing member has a larger radius of curvature in a height direction than the first shock absorbing member to undergo elastic deformation so as to bulge to the outer side of the sole.

8. The shock absorbing structure for a shoe sole according to claim 1, wherein at least one of the first shock absorbing member and the second shock absorbing member is formed to have a structure which is more easily deformed, when the first shock absorbing member receives pressure, toward a bottom face side or a rear side of the shoe sole.

9. The shock absorbing structure for a shoe sole according to claim 1, wherein the first shock absorbing member and the second shock absorbing member are formed so that height dimensions become gradually smaller toward a front of the shoe sole or a load shift direction when the first shock absorbing member receives pressure.

10. The shock absorbing structure for a shoe sole according to claim 1, wherein at least one of the first shock absorbing member and the second shock absorbing member comprises a guide structure that guides the received pressure load to a front of the shoe or a load shift direction when the first shock absorbing member receives pressure.

11. The shock absorbing structure for a shoe sole according to claim 1, wherein an auxiliary element that receives the pressure load and performs compression deformation to assist in absorbing impact is provided inside the first shock absorbing member.

12. The shock absorbing structure for a shoe sole according to claim 1, wherein the second shock absorbing member is configured to detach from the shoe sole.

13. A shoe formed by incorporating the shock absorbing structure of claim 1, the shock absorbing structure configured to absorb an impact that is applied to a leg of a wearer at a time of landing on a ground.

* * * * *